United States Patent [19]

Ragland

[11] 4,377,060

[45] Mar. 22, 1983

[54] WALL CONSTRUCTION

[76] Inventor: Douglas Ragland, P.O. Box 55527, Houston, Tex. 77055

[21] Appl. No.: 180,833

[22] Filed: Aug. 25, 1980

Related U.S. Application Data

[63] Continuation of Ser. No. 933,744, Aug. 15, 1978, abandoned.

[51] Int. Cl.[3] ..... E04B 1/38

[52] U.S. Cl. ..... 52/489; 52/361; 52/481; 52/714

[58] Field of Search ..... 52/489, 483, 714, 715, 52/509, 357, 359, 360, 361, 481; 24/259 R

[56] References Cited

U.S. PATENT DOCUMENTS

| | | | |
|---|---|---|---|
| 1,931,909 | 10/1933 | Venzie | 52/357 |
| 2,282,631 | 5/1942 | Winship | 52/361 |
| 2,317,428 | 4/1943 | Anderson | 52/714 |
| 2,325,766 | 8/1943 | Gisondi | 52/489 |
| 3,187,389 | 6/1965 | Anderson | 52/489 |
| 3,357,148 | 12/1967 | Turner | 52/489 |
| 3,711,137 | 1/1973 | Tinnermann | 52/714 |
| 3,922,764 | 12/1975 | Downing | 24/259 R |

FOREIGN PATENT DOCUMENTS

| | | | |
|---|---|---|---|
| 1,034,733 | 7/1978 | Canada | 52/489 |
| 658,374 | 10/1951 | United Kingdom | 52/489 |

*Primary Examiner*—John E. Murtagh

*Attorney, Agent, or Firm*—Browning, Bushman & Zamecki

[57] ABSTRACT

A wall construction utilizing unique fastening clips to demountably secure wall panels to a suitable supporting structure, such as a stud, the fastening clips being constructed such that the outer surface of adjacent panels are maintained substantially flush.

14 Claims, 3 Drawing Figures

WALL CONSTRUCTION

This is a continuation, of application Ser. No. 933,744, filed Aug. 15, 1978 now abandoned.

BACKGROUND OF THE INVENTION

The present invention relates to wall construction, and, more particularly, to a form of dry wall construction in which wall panels are removably secured to a supporting structural framework comprised of studs or the like by means of fastening clips.

It is extremely desirable, particularly in commercial building construction, to provide building partitions and walls and systems for assembling such partitions and walls in which the entire partition of wall may be easily removed or in which individual panel members making up the partition or wall can be removed, rearranged or replaced with doors, windows or other openings or units. Numerous systems and wall construction methods have been proposed for accomplishing this result. Many of the systems proposed rely on the use of specially constructed panels which permit them to be removably disposed on the supporting structure and/or utilize supporting structures, e.g. studs, which are of special design and hence expensive to manufacture.

Typical of demountable dry wall construction systems which use fastening clips to removably secure panels to wall studs is the system shown in U.S. Pat. No. 3,922,764 to Downing, Jr.

The fastening clips used in the system disclosed in the Downing patent, as well as fastening clips used in other prior art systems suffer from the disadvantage that if the wall panel is warped or bowed, a flush joint between abutting channels is difficult to achieve. Additionally, most prior art fastening clips which employ resilient gripping of the support member by the clip suffer from the disadvantage that the clip can easily slip off of the support member. This is particularly true in the cases where the wall panel is warped and hence the fastening clip is subjected to higher than normal disengagement forces.

SUMMARY OF THE INVENTION

It is therefore an object of the present invention to provide an improved wall construction.

Another object of the present invention is to provide an improved fastening clip for securing a wall panel to a support member.

Still a further object of the present invention is to provide a fastening clip for securing a wall panel to a support member wherein the fastening clip is provided with means for ensuring that the wall panels are maintained flush at their adjacent edges.

A further object of the present invention is to provide an improved fastening clip for securing a wall panel to a support member which provides increased gripping force between the support member and the fastening clip.

Yet another object of the present invention is to provide a method of forming a fastening clip used for securing a wall panel to a support member.

The above and other objects of the present invention will become apparent from the drawings, the description given herein and the appended claims.

In accordance with the above stated objects, the present invention provides a fastening clip for securing a panel having a side edge to a support member. The fastening clip is comprised of a base portion having front and back sides and first and second edges. A leg portion depends from the first edge in a direction generally outwardly form the front side of the base portion, the leg portion including retaining means in the form of prongs which are forced into the side edge of the panel to thereby secure the clip to the panel. A tongue or guide portion extends laterally outwardly from the second edge of the base portion and has a guide surface formed by an extension of the front side of the base portion. A gripping finger is disposed adjacent the back side of the base portion and is connected to the second edge of the base portion, preferably by a ribbed web, the gripping finger being resiliently movable away from the back side whereby a portion, e.g. a flange, of a support member may be gripped between the back side of the base member and the gripping finger to thereby secure the panel to the support member.

There is further provided by the present invention a wall construction comprising a wall panel having a marginal side edge, suitable support structure such as provided by studs and the above described fastening clips for securing the panel to the support structure.

The present invention also contemplates a method for forming the above described fastening clips from a substantially flat, relatively thin section of metal. The section of metal comprises a front side, a back side, a front edge, a back edge, a first side edge, a second side edge and a retaining means which projects outwardly from the front edge. In the method, the metal section is worked adjacent the front edge to form a leg portion depending in a direction generally outwardly from the front side, the retaining means projecting from the leg portion. First and second cuts are then made in the metal section between the side edges, the cuts extending from the back edge toward the front edge. The portions of the metal section between the first cut and the first side edge and the second cut and the second side edge are then formed into gripping fingers by bending such portions, relative to the metal section, to position the portions adjacent the back side of the metal section. This leaves a tongue having a guide surface formed by an extension of the front side of the metal section. Preferably, the first and second cuts are made by shearing.

DESCRIPTION OF THE PREFERRED EMBODIMENTS

Figure 1:
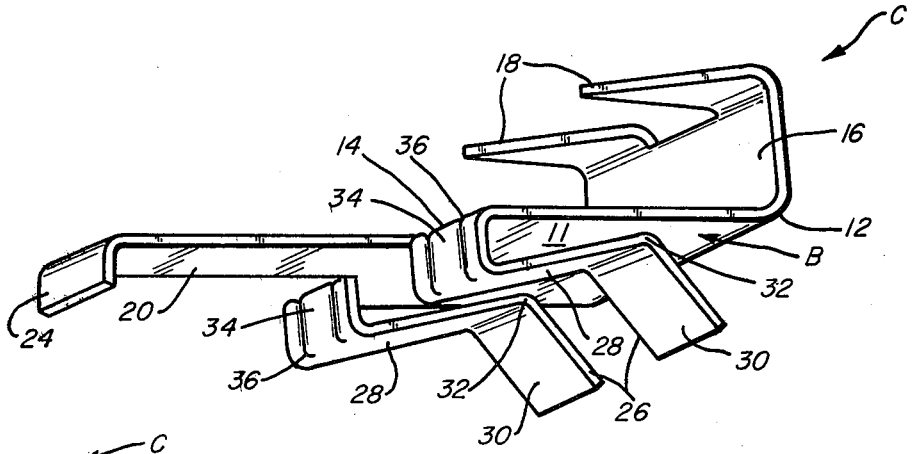
FIG. 1 is a perspective view of a fastening clip according to the present invention.
Figure 2:
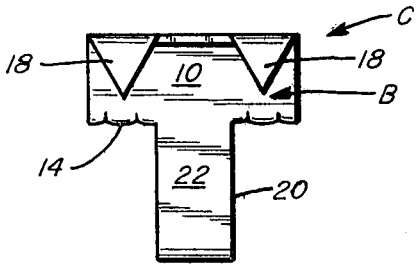
FIG. 2 is a plan view of the fastening clip shown in FIG. 1.

Referring first to FIGS. 1 and 2, the fastening clip C of the present invention comprises a base portion, shown generally as B, having a front side 10, a back side 11, a first edge 12 and a second edge 14. A leg portion 16 depends from first edge 12 in a direction generally away or outwardly from front side 10. Formed on leg portion 16 are a pair of prongs 18 extending generally parallel to front side 10 toward second edge 14. While, as shown, the fastening clip is provided with two prongs 18, it will be understood that a single, generally centrally disposed prong depending from leg 16 will work satisfactorily. As will be seen hereafter, prongs 18 serve as retaining means to secure clip C to the marginal edge of a wall panel.

Extending generally laterally outwardly from edge 14 of base B is a tongue 20. Tongue 20 is provided with a guide surface 22 which is formed by an extension of front side 10 of base B. Tongue 20 terminates at its free end in a depending guide flange 24. As will be seen hereafter, guide flange 24 serves to prevent the free end of tongue 20 from having sharp edges or corners which might grab or dig into the back side of the panel members when the clips are attached.

Clip C is also provided with a pair of gripping fingers 26 disposed generally adjacent the back side 11 of base B. Gripping fingers 26, which, as shown, are generally identical in configuration, comprise a first section 28 which is angled in a direction generally towards back side 11 of base portion B and a second section 30 angled in a direction away from the back side 11 of base B. The intersection of the sections 28 and 30 forms a gripping bead 32 whose purpose will be seen hereafter. Gripping fingers 26 are interconnected to the second edge 14 of base B by webs 34. Each of webs 34 is ribbed as at 36 to provide increased stiffness and strength. It will be appreciated that gripping fingers 26 can be urged outwardly away from the back side 11 of base B to permit a support member to be gripped between the back side 11 of base B and the gripping bead 32 of gripping fingers 26. Because clips C are made of metal having a certain degree of resiliency or elasticity, gripping fingers 26 are resiliently movable away from the back side 11 of base B. Thus, a support member will be firmly gripped between the back side 11 of base B and the gripping bead 32 of gripping fingers 26. The length of the first section 28 of gripping fingers 26 is selected to give a lever arm between bead 32 and web 34 to ensure the necessary resiliency. The presence of the ribs 36 on web 34, which tends to stiffen web 34 relative to gripping fingers 26 ensures that fingers 26 and hence gripping bead 32 will be urged tightly against the support member thereby securely clamping the support member between the back side 11 of base B and the bead 32 of gripping fingers 26.

In manufacturing the fastening clips described above, a blank comprised of a substantially flat, relatively thin section of metal is first provided. The blank can be stamped out of a larger section of metal such as for example, a strip or sheet and upon stamping will be provided with the prongs 18. The blank which will then have a front side corresponding to side 10, a front edge corresponding to edge 12, a back edge corresponding to edge 14 and first and second side edges extending between the front and back edges. The blank is worked adjacent the front edge, e.g. edge 12, to provide a leg portion, e.g. 16. This is accomplished in a suitable forming die. Guide flange 24 is also formed in a suitable forming die as well as ribs 36 in webs 34. First and second cuts are made in the blank, the cuts extending from the back edge toward the front edge. The cuts are preferably made by shearing the blank. The gripping fingers, e.g. fingers 26, are formed by bending the portions of the metal section between the two cuts and the respective side edges such that such portions are positioned adjacent the back side of the metal section and are formed with a gripping bead, e.g. bead 32. There is thus provided a guide tongue, e.g. tongue 20.

Figure 3:
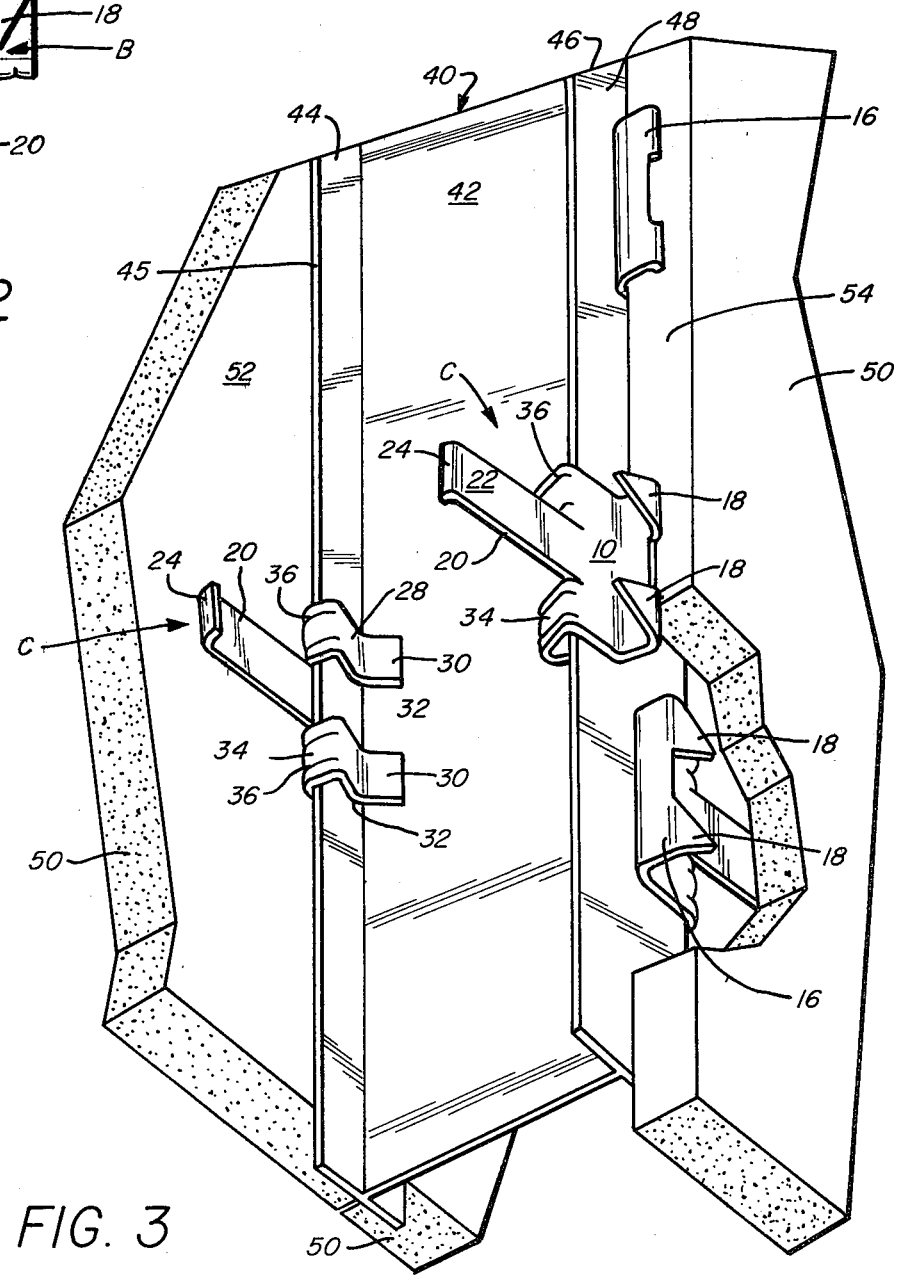
FIG. 3 is a fragmentary, perspective view of the wall construction according to the present invention.

Referring now to FIG. 3, there is shown, in detail, a wall construction of the present invention using the fastening clips described above. While the wall construction will be described with reference to a single stud or support member, it will be understood that in a typical wall construction, there will be a plurality of studs or support members suitably spaced to accommodate the width of the particular wall panel chosen. It will also be appreciated, as shown hereafter, that the spacing of the studs or support members will be such that the joints formed between abutting or adjacent wall panels will coincide with the position of a stud. The wall construction includes a support member 40 which is a conventional so-called H-shaped stud comprised of a central web 42 carrying support flanges 44 and 46 on opposing edges, flanges 44 and 46 being generally at right angles to web 42. Support flanges 44 and 46 are substantially identical and it will be understood that certain construction features of the flanges are shown by flange 46 while others are shown by flange 44. Thus, for example, while the construction of only one of the flange members may be described with regard to certain details, it will be understood that the other flange member has the same or similar construction. Flange member 46 is provided with a support surface 48 which generally faces outwardly toward the wall panel. It will be seen that support member 40 provides an air space or plenum between back to back wall sections, such plenum being used for the installation of wiring, plumbing, etc. It will also be understood that support members 40 are held in vertical or horizontal position by means well known in the art. Thus, for example, if studs 40 form part of a vertical wall section or partition, they will be secured at the floor and ceiling levels by conventional methods.

The wall construction further includes wall panels 50 which can be made of gypsum, wood, plastic, etc. In securing panels 50 to support members or studs 40, fastening clips C are first secured to panel 50. This is accomplished by placing guide surface 22 of tongue 20 on the back side 52 of panel 50 adjacent the marginal edge 54 of panel 50. Prongs 18 are then pushed into the marginal edge 54, guide surface 22 being held firmly against the back surface 52 of panel 50. It will be appreciated and as shown in FIG. 3, that a plurality of fastening clips C will be attached to wall panels 50, fastening clips C being spaced along the marginal edge 54. When the desired number of fastening clips C has been attached to panel 50, the panel can then be secured to the support member or stud 40. To accomplish this, panel 50 with the attached fastening clips C is disposed adjacent stud 40 and, more particularly, is disposed such that an edge of one of the support flanges, e.g. edge 45 of support flange 44, is received between the back side 11 of base B and sections 30 of the gripping fingers 26. Pressure is then applied so as to urge the panel 50 in a direction across the support surface 48 of flange 46 such that flange 46 will be forced between the beads 32 of resilient gripping fingers 26 and the back side 11 of base B. When the edge 45 of the flange 44 contacts the web 34 of the fastening clip C, the panel is then securely in place and affixed to stud 40. Suceeding panels are attached to stud 40 in a similar manner.

As best seen with reference to FIG. 3, the extended surface 22 provided by tongue 20 aids in keeping the panels flush and pulled tightly toward the stud 40. As is well known, wall panels are commonly bowed or warped with the result that using conventional fastening clips, flush, abutting joints are not formed between adjacent panels. The fastening clip of the present invention overcomes that problem. The relatively long length of the tongue 20 and the guide surface 22 provided thereby acts to pull any bow or warp out of the wall panel and thereby ensure that flush joints are formed between adjacent panels.

The invention may be embodied in other specific forms without departing from the spirit or essential characteristics thereof. The present embodiments are therefore to be considered, in all respects, as illustrative and not restrictive, the scope of the invention being indicated by the appended claims rather than by the foregoing description, and all changes which come within the meaning and range of equivalence of the claims are therefore intended to be embraced therein.

I claim:

1. A fastening clip for securing a panel having a side edge to a support member comprising:

a base portion having a front side, a back side, a first edge, a second edge, a third edge and a fourth edge, a leg portion depending from said first edge in a direction generally outwardly from said first side, said leg portion including retaining means to secure said clip to said side edge of said panel, an elongate tongue portion extending generally laterally outwardly and generally centrally from said second edge of said base portion, said tongue portion being narrower in width than said base portion between said third and fourth edges and having a guide surface formed by an extension of said front side, first and second gripping fingers disposed adjacent said back side of said base portion, said tongue portion and said gripping fingers extending in generally opposite directions from one another, and first and second means interconnecting said first and second gripping fingers, respectively, to said second edge, said first and second means being connected to said second edge on opposite sides of said tongue portion, said gripping fingers being resiliently movable away from said back side whereby said support member may be gripped between said back side of said base member and said gripping fingers.

2. The clip of claim 1 wherein said base portion has a generally flat front side.

3. The clip of claim 1 wherein said retaining means comprises at least one prong depending from said leg portion, said prong extending in generally the same direction as said tongue portion and adapted to extend into the marginal side edge of said panel.

4. The clip of claim 1 wherein each of said gripping fingers has a first section connected to said interconnecting means angled in a direction toward said back side of said base portion and a second section forming the free end of said gripping finger and angled generally away from said back side of said base portion to thereby form a gripping bead intermediate the free end of said gripping finger and said interconnecting means.

5. The clip of claim 1 wherein said interconnecting means comprises a web adjoined to said base portion and said gripping finger.

6. The clip of claim 5 wherein said web includes formations for increasing the stiffness of said web relative to that of said gripping finger.

7. The clip of claim 6 wherein said formations comprise ribs formed in said web.

8. A wall construction comprising:

a panel forming at least a portion of a wall section, said panel having a marginal side edge;

a support member, a fastening clip for securing said panel to said support member, said clip comprising:

a base portion having a front side, a back side, a first edge, a second edge, a third edge and a fourth edge, a leg portion depending from said first edge in a direction generally outwardly from said front side and adapted to be engaged with said side edge of said panel, said leg including retaining means to secure said clip to said panel, an elongate tongue portion extending generally laterally outwardly and generally centrally from said second edge of said base portion, said tongue portion being narrower in width than said base portion between said third and fourth edges and having a guide surface formed by an extension of said front side of said base portion, said tongue portion engaging the back face of said panel, first and second gripping fingers disposed adjacent said back side of said base portion, said tongue portion and said gripping fingers extending in generally opposite directions from one another, and first and second means interconnecting said first and second gripping fingers, respectively, to said second edge, said first and second means being connected to said second edge on opposite sides of said tongue portion, said gripping fingers being resiliently movable away from said back side, said support member being gripped between said back side of said face member and said gripping fingers to thereby secure said panel to said support member.

9. The wall construction of claim 8 wherein said base portion has a generally flat front side.

10. The wall construction of claim 8 wherein said retaining means comprises at least one prong depending from said leg portion, said prong extending in generally the same direction as said tongue portion and into the marginal side edge of said panel.

11. The wall construction of claim 8 wherein each of said gripping fingers has a first section connected to said interconnecting means angled in a direction toward said back side of said base portion and a second section forming the free end of said gripping finger and angled generally away from said back side of said base portion to thereby form a gripping bead intermediate the free end of said gripping finger and said interconnecting means, a portion of said support member being gripped between said bead and said back side of said base portion.

12. The wall construction of claim 8 wherein said interconnecting means comprises a web adjacent to said base portion and said gripping finger.

13. The wall construction of claim 12 wherein said web includes formations for increasing the stiffness of said web relative to that of said gripping finger.

14. The wall construction of claim 13 wherein said formations comprise ribs formed in said web.

* * * * *

UNITED STATES PATENT AND TRADEMARK OFFICE

CERTIFICATE OF CORRECTION

PATENT NO. : 4,377,060

DATED : March 22, 1983

INVENTOR(S) : Douglas Ragland

It is certified that error appears in the above—identified patent and that said Letters Patent is hereby corrected as shown below:

In Column 5, line 20, delete "first" and insert therefor "front".

Signed and Sealed this

*Twenty-seventh* Day of *November 1984*

[SEAL]

*Attest:*

GERALD J. MOSSINGHOFF

*Attesting Officer*

*Commissioner of Patents and Trademarks*